United States Patent [19]

Barrett

[11] Patent Number: 4,913,582

[45] Date of Patent: Apr. 3, 1990

[54] ADJUSTABLE PIPE SCREED SUPPORT

[76] Inventor: Lamar Barrett, 108 Pine Cone Cir., Clanton, Ala. 35045

[21] Appl. No.: 273,899

[22] Filed: Nov. 21, 1988

[51] Int. Cl.[4] ..... E01C 19/22

[52] U.S. Cl. ..... 404/119; 404/136; 248/125; 52/365; 52/678

[58] Field of Search ..... 404/118, 119, 135, 136; 52/365, 678; 248/65, 70, 73, 125, 161, 49, 67.7, 295.1, 354.3; 425/458

[56] References Cited

U.S. PATENT DOCUMENTS

| | | | |
|---|---|---|---|
| 2,281,946 | 5/1942 | O'Neill, Jr. | 52/678 |
| 2,306,671 | 12/1942 | Tamblyn | 404/119 |
| 2,684,222 | 7/1954 | Miller | 248/354.3 |
| 3,006,115 | 10/1961 | Hillberg | 52/365 |
| 3,115,726 | 12/1963 | Sayles | 404/136 |
| 4,115,976 | 9/1978 | Rohrer | 404/119 |
| 4,437,828 | 3/1984 | Egger | 404/119 |
| 4,765,106 | 8/1988 | Modrovich | 248/70 |

*Primary Examiner*—Bruce M. Kisliuk

*Attorney, Agent, or Firm*—Jennings, Carter, Thompson & Veal

[57] ABSTRACT

A screed chair having a base member and at least one threaded vertical member mounted therein supports a screed pipe on a yoke offset from the vertical member such that the yoke and pipe are isolated from rotation during rotation of the vertical member to adjust the height of the screed pipe.

6 Claims, 2 Drawing Sheets

Fig. 2
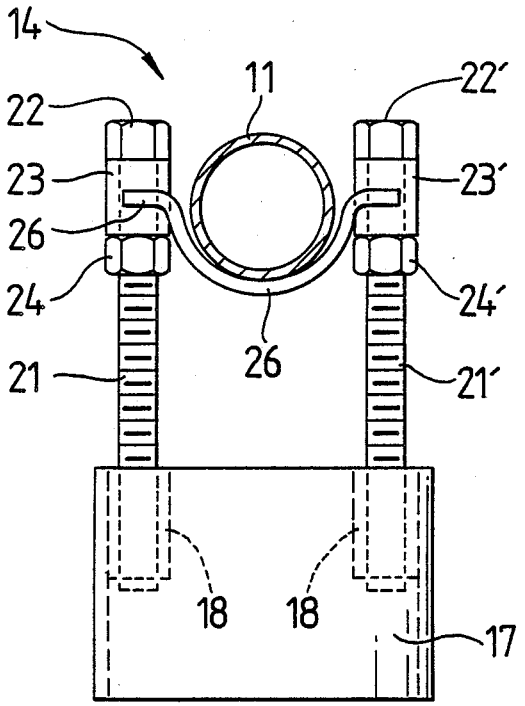
Fig. 3
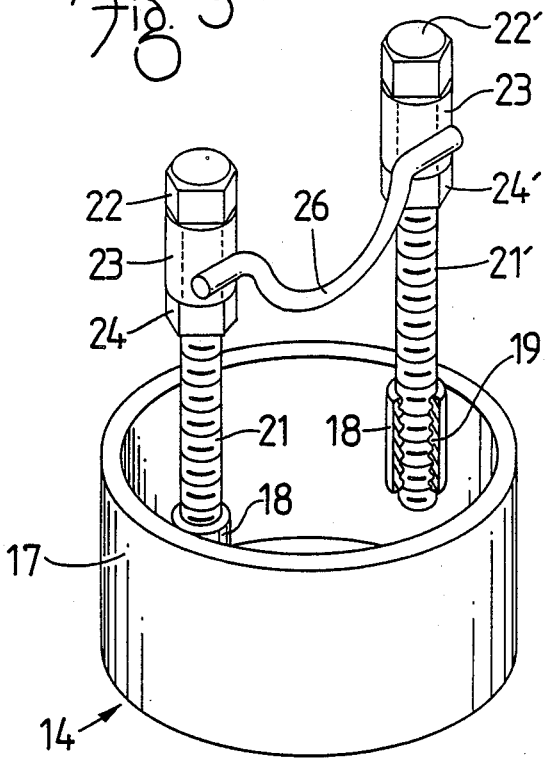
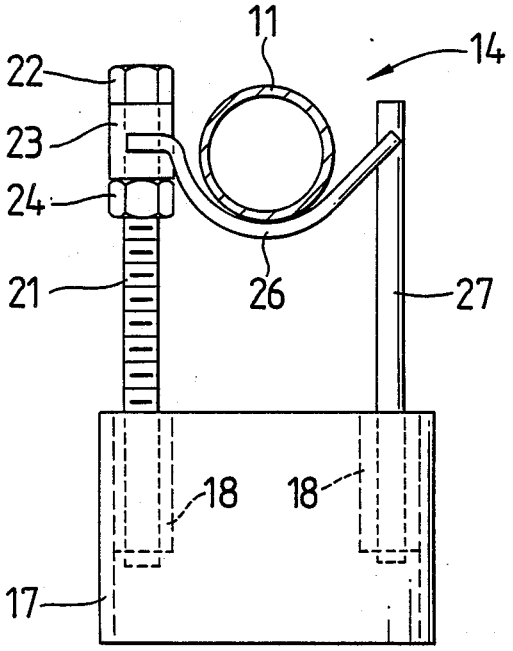
Fig. 4
Fig. 5
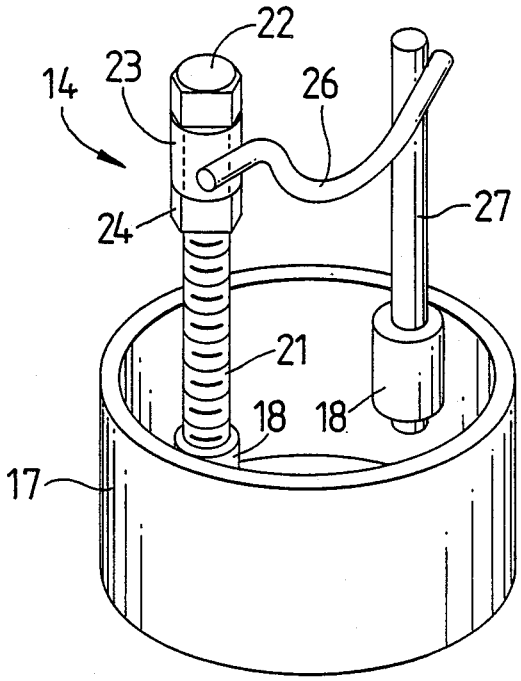

ADJUSTABLE PIPE SCREED SUPPORT

FIELD OF THE INVENTION

The present invention relates to the field of cementious construction and more particularly to the use of pipe screeds in pouring plastic concrete and leveling the same. More particularly the present invention relates to stands for a pipe screed.

BACKGROUND OF THE INVENTION

Current practice utilizes a number of pipe screed choices, some of which are allegedly adjustable in height. Typically a pair of chairs will be used to support a screed pipe. The chairs may rest atop the pouring form or may actually screw into the form. In either case the screed chair normally utilizes a Y-shaped yoke extending upwardly from a vertical member with the yoke and at least a portion of the vertical member being concomitantly rotated to vary the elevation of the yoke and hence the screed. In these devices the screed pipe must be lifted from the yoke to permit rotation of the yoke to adjust the height. Consequently, adjusting the screed height is a somewhat tedious process and substantially reduces the efficiency of the construction process.

To promote greater efficiency in the construction process I have devised a screed chair which can be adjusted in height without removal of the screed pipe or any complicated procedures.

My screed stand utilizes an open bottom base member which rests on the bottom of the form over which the concrete will be poured. The base member has affixed thereto one or more threaded receptacles which engage one or more threaded members which are variable in elevation according to the extent of threaded engagement with the receptacles. The vertical threaded member carries a yoke portion at a predetermined axial location and is rotatable relative to the yoke portion such that rotation of the threaded member within the receptacle does not vary the angular position of the yoke member relative to the base member.

BRIEF DESCRIPTION OF THE DRAWINGS

Apparatus embodying features of my invention are depicted in the accompanying drawings which form a portion of this disclosure and wherein:

FIG. 2 is a side elevation of my screed chair supporting a screed pipe;

FIG. 3 is a perspective view of my screed chair;

FIG. 4 is a side elevation of a second embodiment of my screed chair; and

FIG. 5 is a perspective view of the second embodiment of my screed chair.

DESCRIPTION OF A PREFERRED EMBODIMENT

Figure 1:
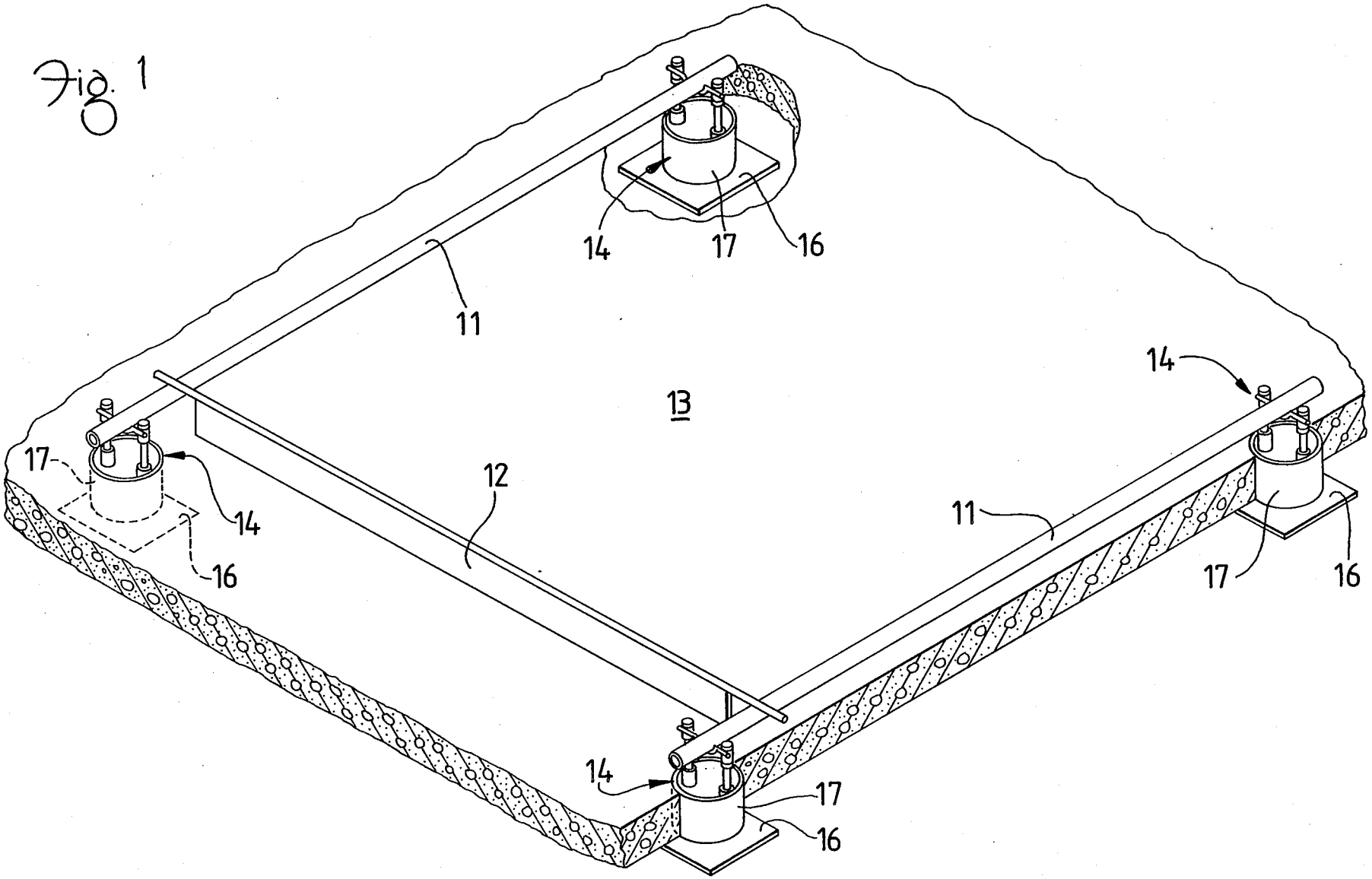
FIG. 1 is a perspective view showing a concrete slab partially in section and partially broken away showing my screed chairs supporting screed pipes and a screed rod.

Referring to the drawings for a clearer understanding of my invention it may be seen in FIG. 1 that a pair of horizontal screed pipes 11 and a screed rod 12, which may be a vibrating screed but which is shown in generic form in this application, define a plane which is the top of the concrete slab 13 to be formed. The use of a pipe screed is well known in the art and the generic illustration of the pipes 11 and rods 12 are not intended as limitations on the type screed structures with which my invention may be used.

My screed chair is shown generally at 14 and may rest directly on the form in which the concrete is poured or may rest on a thin metallic plate 16 to provide stability on an uneven subsurface. The screed chair 14 comprises a base member 17 which is tubular and open ended at the top and bottom. Internally of the base members are a pair of receptacles 18 affixed to the inner surface of the base member 17. The receptacles 17 are internally threaded as at 19 and may be a coil nut welded to the base member 17. Threaded engaged within the receptacle 17 is a vertical member 21 which may be a coil rod with a hex head 22. The vertical member 21 is encased over a portion of its length by a sleeve 23 which is not threaded and which is freely rotatable about the vertical member 21. Threadedly engaged on the vertical member 21 beneath the sleeve 23 is a retaining nut 24 which is spot welded to the coil rod such that sleeve 23 is captured between the retaining nut 23 and the hex head 22. Thus the sleeve 23 remains freely rotatable but is fixed in axial position relative to the top of the vertical member 21. Welded to the sleeve 23 is a yoke member 26 which has a generally U-shaped configuration and which extends laterally from the sleeve 23 to support the screed pipe 11. The yoke 26 is welded to a second sleeve 23' mounted on a second threaded member 21' in the same manner as heretofore described and as shown in FIGS. 2 and 3. In an alternative embodiment shown in FIGS. 4 and 5 the yoke member 26 is welded to a vertical rod 27 which is freely movable vertically in a second receptacle 18.

Regardless of which embodiment is employed, it can be seen that the pipe 11 is supported laterally from the vertical member 21, thus the hex head is always accessible for rotation by a tool 28 such as shown in FIG. 1. Furthermore since the sleeve 23 is freely rotatable about the vertical member 21 the vertical member 21 can be rotated and the height of the sleeve 23 and yoke 26 adjusted with pipe 11 supported on the yoke 26. Thus, no trial and error procedures are necessary, such as when the screed chair is adjusted. Instead the pipe 11 can be positioned correctly and directly aligned in place on the yoke 26. Additionally tool 28 can be appropriately sized to allow a workman to adjust the chair from a standing position, thus eliminating the "up and down"' wasted motion of the workman found in conventional screed chairs.

While 1 have shown my invention in two forms, it will be obvious to those skilled in the art that it is not so limited but is susceptible of various changes and modifications without departing from the spirit thereof.

What I claim is:

1. A reusable screed chair for supporting a screen on a screed support comprising:

(a) a base tubular member having an open bottom;

(b) a pair of receptacles affixed to the inside of said base member with at least one of said receptacles being internally threaded;

(c) an upstanding vertical member threadedly engaged within one of said receptacles; and (d) means connected to said vertical member for supporting a screed support at a predetermined position laterally of said vertical member such that threaded vertical member may be rotated in threaded engagement with said one of said receptacles to vary the height of said screed support without rotating said screed support.

2. A screed chair as defined in claim 1 wherein said means for supporting comprises:

(a) a sleeve-like member rotatably supported on said vertical member at a fixed position relative to the upper end thereof; and (b) a yoke-like member having one end affixed to said sleeve-like member and a second end extending generally horizontally therefrom above said base member.

3. A screed chair as defined in claim 2 wherein said means for supporting further comprises a second vertical member connected to the second end of said yoke-like member and engaged within the other one of said receptacles.

4. A screed chair as defined in claim 3 where said second vertical member is threadedly engaged within said second receptacle and said second end of said yoke-like member is affixed to a sleeve-like member rotatably supported on said second vertical member at a fixed height relates thereto.

5. A screed chair as defined in claim 2 wherein said vertical member comprises a threaded bolt having a bolt head for rotation thereof at the upper end thereof and an annular retaining member threadedly engaged thereon with said sleeve-like member captured on said threaded bolt between said bolt head and said annular retaining member.

6. A screed chair as defined in claim 1 wherein said base member is round.

* * * * *